US006749277B2

(12) United States Patent
Michaels

(10) Patent No.: US 6,749,277 B2
(45) Date of Patent: Jun. 15, 2004

(54) DRAWER SLIDE ASSEMBLY

(75) Inventor: Philip R. Michaels, Fullerton, CA (US)

(73) Assignee: Amos Industries, Inc., Warrenville, IL (US)

( * ) Notice: Subject to any disclaimer, the term of this patent is extended or adjusted under 35 U.S.C. 154(b) by 38 days.

(21) Appl. No.: 10/279,313

(22) Filed: Oct. 23, 2002

(65) Prior Publication Data

US 2004/0080246 A1 Apr. 29, 2004

(51) Int. Cl.[7] ..... A47B 88/00
(52) U.S. Cl. ..... 312/334.5; 312/334.27
(58) Field of Search ..... 312/334.4, 334.5, 312/334.27, 334.29, 334.32, 334.33, 334.34, 334.36, 334.8; 248/298.1, 297.31, 225.11; 384/22; 403/109.1, 109.2, 109.8, 377

(56) References Cited

U.S. PATENT DOCUMENTS 3,022,129 A * 2/1962 Manson ..... 312/334.38
3,092,429 A * 6/1963 Barnes ..... 312/333
3,119,644 A * 1/1964 Workman ..... 384/20
3,201,187 A * 8/1965 Reiss, Sr. et al. ..... 312/334.34
3,650,577 A * 3/1972 Gutner ..... 384/21
4,534,600 A * 8/1985 Cosme ..... 384/23
5,275,483 A * 1/1994 Rasmussen ..... 312/334.41
5,779,206 A * 7/1998 Harris et al. ..... 248/214
6,116,706 A * 9/2000 Pomerleau et al. .... 312/334.31
6,254,052 B1 * 7/2001 Hubbard et al. ..... 248/313

FOREIGN PATENT DOCUMENTS

WO WO 00/01278 * 1/2000 ..... 312/334.5

* cited by examiner

*Primary Examiner*—Janet M. Wilkens

(57) ABSTRACT

A drawer slide assembly comprising fixed and movable slides with the movable assembly being adapted to be attached to a drawer and the fixed slide attached to a cabinet or furniture article, along with a ball carrier and ball bearings disposed between the two slides. The movable slide further includes a bracket at or near the rear end thereof and which is attachable to the rear of a drawer to help minimize or prevent separation of the movable slide from the fixed slide when a drawer is moved in and out of the cabinet or furniture. Furthermore, the assembly includes an L-shaped bracket with tabs which readily engage in an elongated slot at the rear end of the fixed slide to facilitate adjustment and assembly of the slide assembly to a cabinet or furniture, and to work with a drawer member with a clutch.

7 Claims, 2 Drawing Sheets

DRAWER SLIDE ASSEMBLY

The present invention relates to cabinetry and the like, and more particularly to an improved form of drawer slide assembly for use in cabinets and furniture for mounting a drawer therein.

BACKGROUND OF THE INVENTION

Various forms of slides, brackets and the like have been developed over the years for mounting drawers in cabinets and furniture for facilitating smooth movement of the drawer in and out of the cabinet or furniture. In the early days, the lower side edges and/or the middle section of the bottom of a drawer slid in and out on wooden rails within the cabinet. More modern structures have included a two piece metal slide having a ball bearing race assembly between the two slide sections, and wherein one slide section is affixed to the bottom or sides of the drawer and the other section is attached to the cabinet.

In constructing cabinets and furniture with drawers, it is desirable to simplify, as much as possible, the proper placement of components such as drawer slides and to provide a sufficiently rigid assembly. Unfortunately, the former slide devices have not satisfactorily solved these drawer slide problems.

SUMMARY OF THE INVENTION

The present invention addresses the assembly problem by combining two components to an essentially standard drawer slide. The first is termed a clutch which is affixed to the slide which will be attached to the bottom of a drawer so as to act as a guide when inserting the drawer in the cabinet. The second is an L-shaped bracket of a new design which adjustably and securely couples with the cabinet slide in a simple manner and which, easily and simply is attachable to a cross brace in a cabinet or piece of furniture to simply orient the overall slide assembly with respect to the cabinet and allow the same to be easily affixed thereto.

There also is a problem of the movable or telescoping section of a two part slide (which extends outwardly as a drawer is opened) separating from the fixed slide in the cabinet or furniture. This is considered to be undesirable. This is not an uncommon problem for furniture when the slide is fully extended and downward force is placed on the drawer front. The clutch aids in solving this problem and the bracket is designed to accommodate the clutch and to provide a rigid drawer slide assembly.

Accordingly, it is a principal object of the present invention to provide an improved form of drawer slide assembly.

An additional object of the present invention is to provide a new form of bracket for a drawer side assembly.

A further object of the present invention is to provide a drawer slide which facilitates proper installation and alignment of a drawer.

BRIEF DESCRIPTION OF THE DRAWINGS

Additional objects and features of the present invention will become better understood through a consideration of the following description taken in conjunction with the drawings in which.

DETAILED DESCRIPTION

Figure 1:
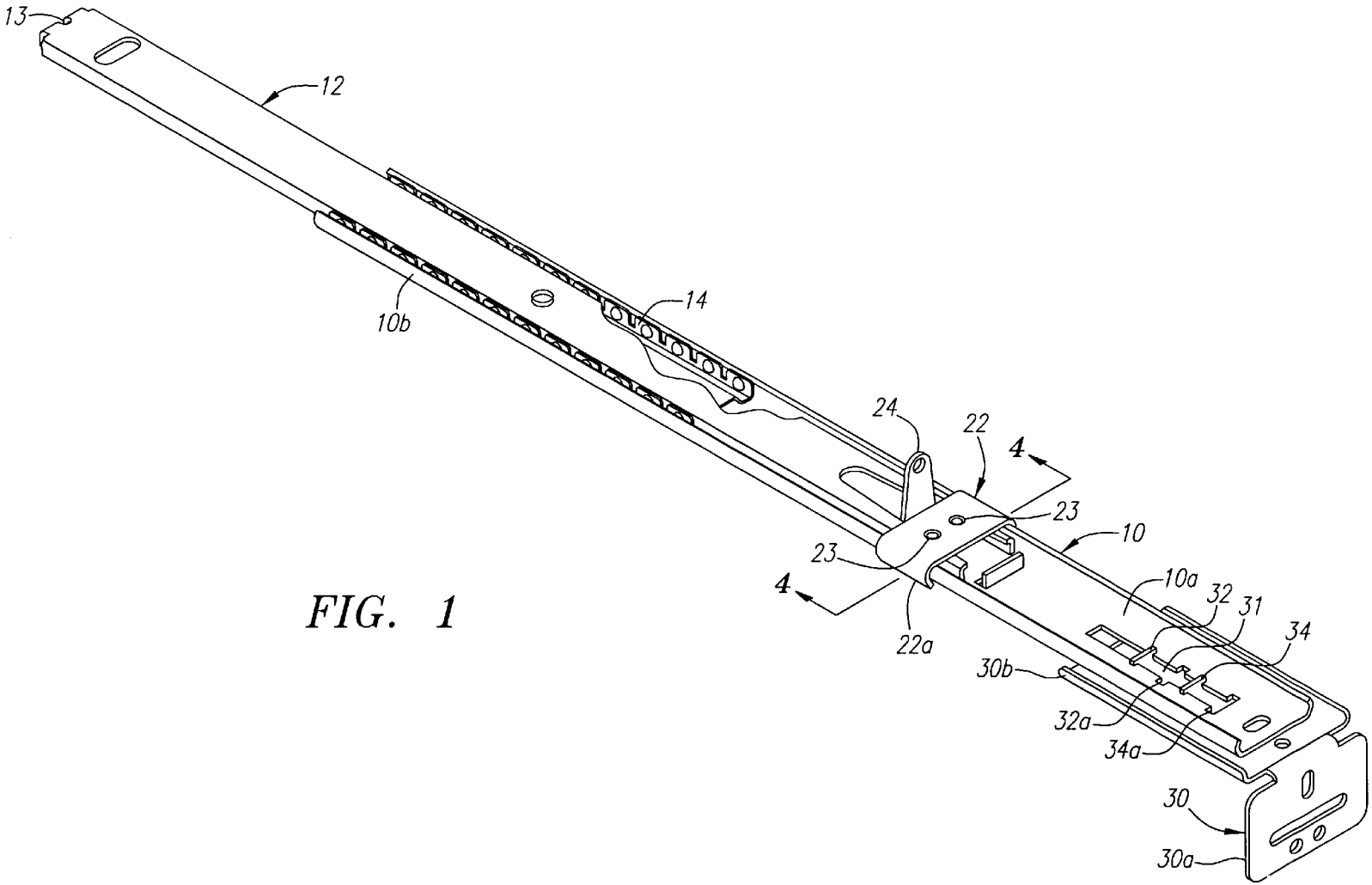
FIG. 1 is a perspective view of a drawer slide assembly according to the present invention.
Figure 2:
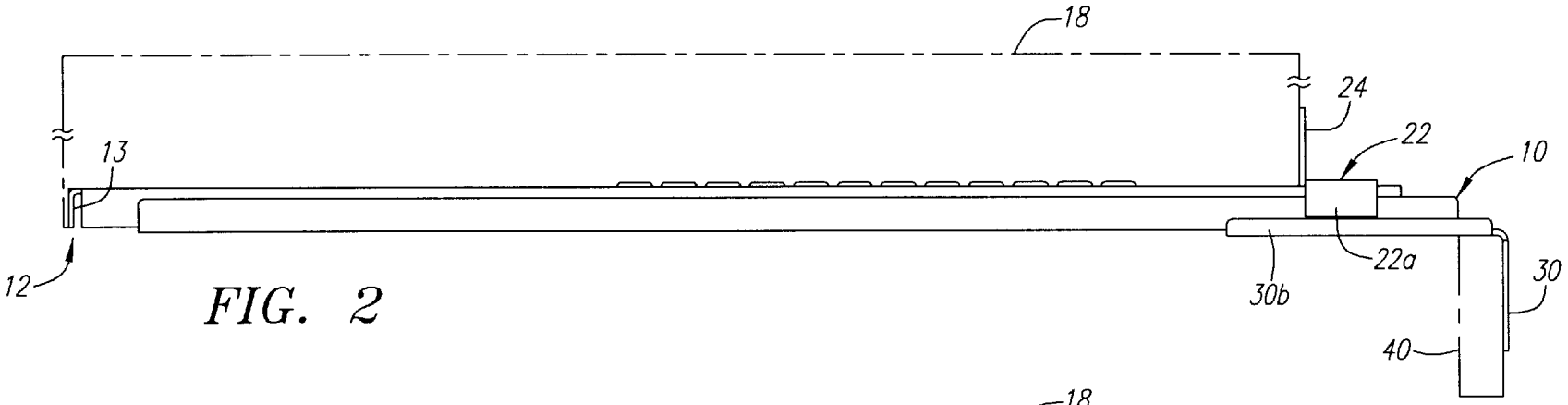
FIG. 2 is a side elevational view of the drawer slide assembly as connected with a drawer and cabinet rail which are shown in phantom lines.
Figure 3:
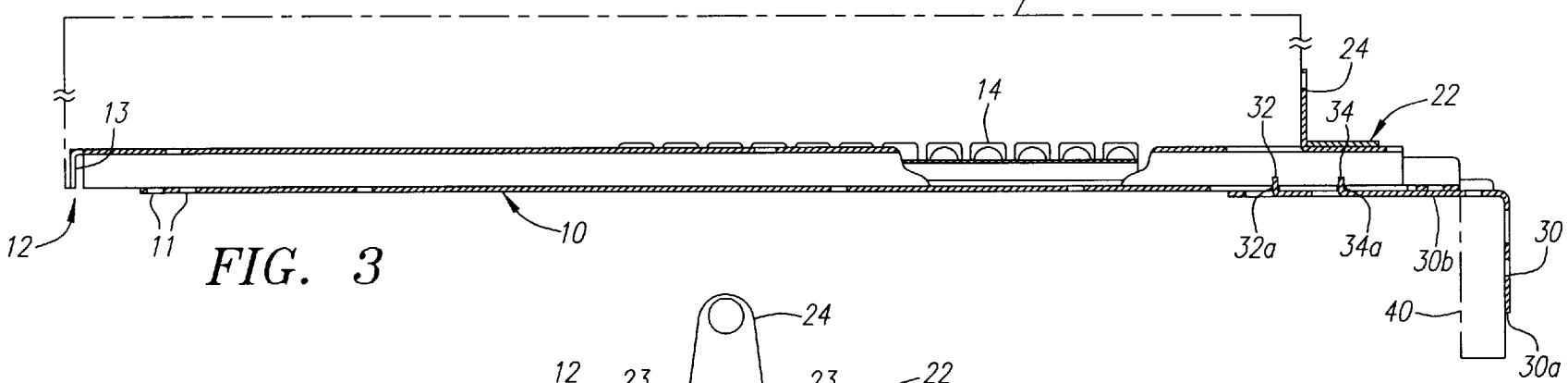
FIG. 3 is a view similar to FIG. 2 but providing a cross-sectional view of the drawer side and components thereof.

FIG. 1 shows in perspective a drawer slide assembly comprising a stationary or cabinet lower slide 10, and an upper movable drawer slide 12. A ball bearing carrier 14 is disposed between the two slides 10 and 12, and a plurality of ball bearings are disposed in the ball carrier in between the two slides 10 and 12. The slide 10 has a mounting hole 11 at the front end (to the left in FIG. 3) to allow it to be secured to a cabinet frame member. The drawer slide 12 has a forked front forming a slot 13 in the forward skirt to allow the skirt to be secured to the bottom front of a drawer. This is a conventional drawer slide assembly, and FIGS. 2 and 3 illustrate a drawer 18 in phantom lines affixed to the upper movable slide 12.

Figure 4:
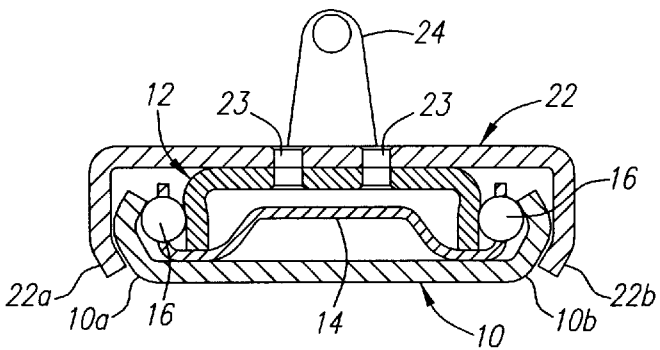
FIG. 4 is a cross-sectional view of the drawer side and a clutch component thereof.

The present drawer slide assembly includes two components which cooperate with each other and the drawer and cabinet to provide improved operation of the slide assembly and facilitate the proper assembly thereof and particularly to provide a rigid assembly. The first is a U-shaped member referred to herein as a clutch or bracket 22 which is affixed, as by rivets or spot welding 23, to an upper surface of the movable slide 12. The drawer member 12 further has an upstanding member 24 which is attachable to the back of the drawer 18 as best seen in FIGS. 2 and 3. FIG. 4 is a cross-sectional view of the slides 10 and 12, the ball carrier 14, ball bearings 16 and clutch 22. As can be seen from FIG. 4, the clutch 22 is formed in an inverted U-shape having legs 22*a* and 22*b* bent inwardly so as to straddle the sides 10*a* and 10*b* of the bottom slide 10 to help prevent the back end of the upper slide 12 from being separated from the lower side 10 as the drawer (and potentially its heavy contents) is moved outwardly from the cabinet or furniture in use. The configurations of the clutch 22 and slide 10 are complementary as seen in FIG. 4. Thus, the clutch allows a drawer in a cabinet or furniture to be opened fully without disengaging (drawer falling out) even if overweighted (above 35 lbs.) or pressure is exerted downward, e.g., a small child pulling down or stepping in the drawer. It also aids in reinsertion of drawer once it has been removed and avoids damage of the ball bearing carriage, a common problem in this type of slide. It is an easier arrangement because the clutch at the back of the drawer fits around cabinet member at insertion.

Of particular importance is a new form of bracket 30 which is L-shaped with a depending leg 30*a* and an upper section 30*b* having a pair of upstanding T-shaped tabs 32 and 34. The sides of the upper section 30*b* are spaced wide enough to allow the legs 22*a* and 22*b* of the clutch 22 to slide in between them so the slide 12 can go all the way to the back of the cabinet. The leg 30*a* is attached to a frame member of a cabinet. The lower fixed slide 10 has at its rear end 10*a* an elongated slot 31, and a pair of cross slots 32*a* and 34*a* into which the respective T-shaped tabs 32 and 34 fit. Then the slide 10 can be moved (to the right of FIG. 1) with respect to the upper section 30*b* of the bracket 30 to secure the T-shaped tabs in a selectable position along the elongated slot 31. This construction allows the bracket 30 to be readily attachable to the fixed slide 10, the tabs 32 and 34 adjusted along the slot 31 as further explained below, and the depending leg 30*a* to be affixed to a frame or cross-member 40 of the cabinet or furniture.

In the installation of the present drawer assembly on a drawer and its cabinet or furniture, first the drawer member 12 is screwed to the underside of the drawer by using a screw fastener through hold 13 in the front of the drawer slide 12, and securing the upstanding member 24 of the drawer member 12 to the back of the drawer. Then, the bracket 30 is attached to the cabinet slide 10 by inserting the T-shaped tabs 32 and 34 into the cross-slots 32*a* and 34*a*. The bracket 30 is adjusted within the slot 31 of the cabinet slide 10 back and forth as necessary so that the drawer slide assembly fits to the depth of the cabinet. This results in the cabinet slide 10 rear end "floating" at the back of the cabinet. The drawer and drawer slide are now slid into the cabinet, and the drawer front pressed flush against the face frame of the cabinet and held there while screws are inserted into the holes in the leg 30*a* of the bracket 30 to secure the bracket of the rear of the cabinet member and therefor finish the assembly.

This structure facilitates the installation of a drawer slide assembly and provides a rigid drawer slide.

While an embodiment of the present invention has been shown and described, various modifications may be made without departing from the scope of the present invention, and all such modifications and equivalents are intended to be covered.

What is claimed is:

1. A drawer slide assembly comprising a first slide intended to be secured to a cabinet, or other piece of furniture and having an inner end including a slot, a second slide for cooperatively telescoping movement with respect to the first slide and adapted to be fixed to a drawer, a bearing assembly disposed between the two slides for facilitating free and smooth movement of one slide with respect to the other, a first bracket attached to an inner end of the movable slide, and an L-shaped bracket having a first section attachable to the slot in the inner end of the first slide and the first section of the L-shaped bracket has a pair of upstanding tabs for mating with the slot, and the L-shaped bracket having a second section comprising a depending leg attachable to a frame member of a cabinet or furniture.

2. A slide assembly as in claim 1 wherein said first bracket includes an inverted U-shaped section having depending legs straddling the first slide to help prevent the second slide from separating from the first slide.

3. A slide assembly as in claim 1 wherein the inner end of the first slide includes an elongated slot and a pair of cross slots, and the tabs of the first section of the L-shaped bracket comprise a pair of cooperating T-shaped tabs connectable with the respective slots to adjustably lock with the elongated slot.

4. A slide assembly as in claim 1 wherein a first slide has curved upstanding sides, and the first bracket includes an inverted U-shaped section having depending legs comprising in-turned sides for cooperatively straddling the sides of the first slide such that movement of the second slide with respect to the first slide tending to separate the two is substantially prevented by the configurations of the U-shaped section and sides of the first slide.

5. A drawer slide assembly comprising a first slide intended to be secured to a cabinet, or other piece of furniture and having an inner end with a slot, a second slide for cooperatively telescoping movement with respect to the first slide and adapted to be fixed to a drawer, a bearing assembly disposed between the two slides for facilitating free and smooth movement of one slide with respect to the other, and an L-shaped bracket having a first section attachable to an inner end of the first slide and a pair of T-shaped tabs for mating with the slot of the first slide, and the L-shaped bracket having a second section comprising a depending leg attachable to a frame member of a cabinet or furniture.

6. A slide assembly as in claim 5 wherein the inner end of the first slide includes a pair of cross slots, and tabs of the first section of the L-shaped bracket are a pair of cooperating upstanding T-shaped tabs for mating with the respective cross slots.

7. A slide assembly as in claim 6 wherein the first bracket includes an inverted U-shaped section having depending legs cooperatively straddling the first slide to help prevent the second slide from separating from the first slide.

* * * * *